United States Patent [19]

Giebel

[11] Patent Number: 4,608,723

[45] Date of Patent: Sep. 2, 1986

[54] APPARATUS FOR LASTING FOOTWEAR

[75] Inventor: Gerhard Giebel, Bad Soden, Fed. Rep. of Germany

[73] Assignee: USM Corporation, Farmington, Conn.

[21] Appl. No.: 585,437

[22] Filed: Mar. 2, 1984

[30] Foreign Application Priority Data

Mar. 12, 1984 [DE] Fed. Rep. of Germany ..... 3307388

[51] Int. Cl.[4] ..... A43D 21/00

[52] U.S. Cl. ..... 12/10.1; 12/12; 12/12.4

[58] Field of Search ..... 12/10, 10.1, 12, 12.2, 12/12.4

[56] References Cited

U.S. PATENT DOCUMENTS

| | | | |
|---|---|---|---|
| 2,915,763 | 12/1959 | Weisz | 12/12 |
| 2,955,302 | 10/1960 | Schoenmakers | 12/12 |
| 3,399,411 | 9/1968 | Fisk | 12/10.1 |
| 3,579,691 | 5/1971 | Fichtner et al. | 12/12.4 |
| 3,657,745 | 4/1972 | Brown | 12/12.4 |
| 3,675,260 | 7/1972 | Kamborian et al. | 12/10.1 |
| 4,407,033 | 10/1983 | Garner et al. | 12/10.1 |
| 4,470,165 | 9/1984 | Becka | 12/12 |

*Primary Examiner*—Werner H. Schroeder
*Assistant Examiner*—Steven N. Meyers
*Attorney, Agent, or Firm*—Spencer T. Smith

[57] ABSTRACT

Apparatus for lasting footwear comprising a wiper assembly which lays the lasting margin about the insole which prior to lasting is pressed against the last by an adhesive injector plate. By a control the movement of the wiper assembly is arrested in an intermediate position in which the wiper assembly has just traversed the insole margin. By means of a signalling device a "fall away" signal which causes the injector plate to fall away from the insole is supplied when the wiper assembly is arrested. Adjacent the injector plate are provided adhesive injector nozzles which are movable away from the plate. By means of a latching member or a timer member it is ensured that the wiper assembly closes only if the adhesive injector nozzles cannot hinder the movement of the wiper assembly.

7 Claims, 4 Drawing Figures

APPARATUS FOR LASTING FOOTWEAR

BACKGROUND OF THE INVENTION (1) Field of the Invention

This invention is concerned with an apparatus for lasting footwear comprising a wiper assembly which lays the lasting margin over the insole which has been pressed against the last before the lasting by an adhesive injector plate, and a control by which the movement of the wiper assembly is arrested in an intermediate position in which the wiper assembly has just traversed the margin of the insole, the control also comprising a signalling device which supplies a "fall away" signal which effects the falling away of the injector plate from the insole when the wiper assembly is arrested.

(2) Summary of the Prior Art

Such an apparatus with associated control is known from German Patent Specification No. 1904925. In this apparatus, by stopping the wiper assembly in the intermediate position the result is achieved that the injector plate presses the insole to the last bottom as long as possible, namely until, in the intermediate position reached by the wiper assembly, the latter holds the margin of the insole and thus has taken it over. In this way any bending of the insole as the wiper assembly moves inwardly is avoided with certainty, such bending being especially possible otherwise when flexible insoles are being used. Since upon reaching the intermediate position the wiper assembly has already reached significant proximity to the injector plate, the falling away of the injector plate prior to the continued movement of the wiper assembly is ensured by the arresting of the wiper assembly and the "fall away" signal, so that the wiper assembly cannot collide with the injector plate as it continues its movement.

If the adhesive applied by the injector plate extends substantially over the region wiped by the wiper assembly, which region normally extends up to the ball region, then some compromise must be accepted with the injector plate insofar as it has to apply the adhesive for narrow and broad shoes depending upon the shoe size. With wide shoes the adhesive coating necessarily lies further inwardly on the insole than in the case of narrow shoes.

The object of the invention consists in improving the possibility of accommodating the adhesive coating to different shoe widths, while however preserving the need for pressing the insole against the last by means of the injector plate and the taking over of the insole by the wiper assembly in the intermediate position thereof, without thereby losing the required certainty that the wiper assembly cannot collide with a component of the apparatus, for which purpose the "fall away" signal mentioned in the introduction is used to effect the falling away of the injector plate from the insole.

BRIEF SUMMARY OF THE INVENTION

The above problem is resolved in that the "fall away" signal is supplied to a latching member which is controlled by a sensor, which in the region of advance is associated with adhesive injector nozzles movable from adjacent the injector plate away therefrom, in such a manner that as the injector nozzles move, the sensor unlatches the latching member after the nozzles have moved over the region which is wiped by the wiper assembly and when they reach a position in which the wiper assembly can continue its movement, the latching element initiating the closing of the wiper assembly.

A solution in modified form consists in that the "fall away" signal is supplied to a timer member which with regard to adhesive injector nozzles movable from adjacent the injector plate away therefrom initiates the closing of the wiper assembly after the nozzles have moved over an area wiped by the wiper assembly and at the earliest when they have reached a position in which the movement of the wiper assembly can be continued.

In both cases the region wiped by the wiper assembly is provided for in respect of the adhesive coating on the one hand by the injector plate (in the toe region of the shoe) and on the other by the adhesive injector nozzles (in the adjacent region in the direction of the ball region), whereby only that region of the shoe forepart which extends from the toe up to the ball region is left to the injector plate, in which with different shoe sizes the particular width of the shoe is not substantially altered. In the following region, which extends into the ball region and beyond, wherein changes of the shoe size are rendered more strongly noticeable by changes in width, the adhesive coating is achieved by means of the adhesive injector nozzles, which with regard to their guidance can be accommodated in known manner as desired to the particular desired shoe contour, for example by sensing the lasting margin or the insole edge or by template or programmed control. Accordingly, by means of the latching member or the timer member, as the case may be, it is ensured that in this case too the injector nozzles are moved away from the injector plate sufficiently far that the wiper assembly can continue its movement unhindered. In the case of the use of the latching member this is achieved by the feeler which is actuated by the injector nozzles and which unlatches the latching member by means of a signal, while in the case of the use of the timer member this ensures that the "fall away" signal is delayed for a period until the injector nozzles have with certainty reached a position in which they can no longer hinder the continued movement of the wiper assembly.

It is known from German Patent Specification No. 1685424 to provide in addition to an adhesive injector plate adhesive injector nozzles which are moved in the direction from the heel end towards the toe, so that adhesive bands adjacent to one another are applied. In this case the injector plate extends from the toe into the height of the ball region, while the injector nozzles cover the region from the heel end up to the injector plate. In this known apparatus, however, no measures are provided whereby a wiper assembly associated with a lasting region is arrested in an intermediate position, where the lasting region of the assembly corresponds substantially with the area of application of the injector plate. Consequently the patent specification contains no reference to the supply of a particular "fall away" signal in order to ensure that the injector plate has fallen away from the insole before the wiper assembly is closed.

The use of an adhesive injector plate together with adhesive injector nozzles is further known from German Patent Specification No. 1685498 (as laid open to inspection), which shows an apparatus for lasting footwear wherein the adhesive injector nozzles are moved from the adhesive injector plate in a direction towards the heel end. This publication also contains no reference to arresting the wiper assembly in an intermediate position and to the use of a "fall away" signal in such intermediate position for initiating the falling away of the injector plate and the consequent closing of the wiper assembly.

In the case of the use of the latching member the falling away of the injector plate can be controlled differently. On the one hand this can take place so that the "fall away" signal is supplied to the actuating means for the injector plate, bypassing the latching member. In this case, therefore, a relative early falling away of the injector plate takes place. On the other hand, the control can also ensure that the unlatching of the latching member initiates the falling away of the injector plate. In this case the injector plate presses against the insole for a relatively long period, whereby the adhesive applied by the injector plate is then prevented from cooling at too early a time.

Also in the case of the use of the timer member such a different control can be used. On the one hand the "fall away" signal is supplied to the actuating means for the injector plate, bypassing the timer member. In this case, therefore, similarly as in the previously described case a relatively early falling away of the injector plate takes place. On the other hand, the falling away of the injector plate can be initiated also by the timer member itself. In this case, therefore, the pressing of the injector plate against the insole is maintained for a longer period.

In this connection it is pointed out that in the case of the use of the latching member and the initiation of the falling away of the injector plate by the unlatching of the latching member it is possible to select the position of the sensor so that it is actuated by the injector nozzles at a point in time wherein the injector nozzles have not yet completely moved out of the region covered by the wiper assembly. In this case the speed of the movement of the wiper assembly and of the movement of the injector nozzles must be determined relative to one another such that in any event in the closed position of the wiper assembly no injector nozzle stands in the way thereof.

An additional degree of security with respect to the prevention of the collision of the wiper assembly against the injector plate is provided in that the initiation of the continuation of the movement of the wiper assembly as compared with the initiation of the falling away of the injector plate is delayed by a delaying member. In this way it is ensured that the continuation of movement of the wiper assembly is initiated only by the time span defined by the delaying member after the initiation of the falling away of the injector plate. This is especially of significance if, in the apparatus in question, the wiper assembly in its intermediate position is already close to the injector plate.

An injector plate length which takes into account both pressing the insole sufficiently against the last and also the difference in shoe width depending upon different shoe sizes is obtained when the start of the path of the injector nozzles, being adjacent the end of the injector plate facing the ball region, is disposed substantially at the middle of the forepart of the shoe, extending from the toe of the shoe to the ball region. In this case the injector plate extends also up to the middle of the shoe forepart portion, so that it can perform its pressure function in respect of half the length of the shoe forepart, which has generally shown itself to be sufficient. In the middle of the shoe forepart portion changes of shoe size do not have an especially strong influence on a particular width of shoe, so that with such a shape of the injector plate and the guidance of the injector nozzles a large number of shoe shapes and sizes are accommodated with a single injector plate. In this way there arises a certain standardisation for the injector plate, which leads to a significant cheapening of the tools necessary for the lasting operation. In order that, in the transitional region from the injector plate to the path of the injector nozzles, no interruption of the adhesive coating arises, the path of the injector nozzles can be so shaped that it overlaps the position of the injector plate when the latter is in pressing condition. In this case the control for the injector nozzles need merely to be so constructed that, before bringing the injector plate against the insole, the nozzles have traversed a short region which is then, after the continuation of the movement of the injector nozzles away from the toe, also embraced by the injector plate, which is brought into contact with the insole only after the continuation of movement of the injector nozzles.

The apparatus, furthermore, reveals the advantage of the use of different adhesives for the region catered for by the injector plate and the region traversed by the injector nozzles. This is of important because especially the ball region is subjected to substantially stronger flexing movements when the shoe in question is being worn than is the case for the toe region. For this purpose the injector plate and the injector nozzles are connected to separate adhesive supplies each with different adhesive, an adhesive which remains elastic being supplied to the injector nozzles, while the injector plate has an adhesive which hardens off more strongly. The latter adhesive normally has the property that it hardens off more quickly, which is of special significance for rapid and reliable bonding in the toe region.

BRIEF DESCRIPTION OF THE DRAWINGS

In the drawings exemplary embodiments of the invention are shown.

DESCRIPTION OF THE PREFERRED EMBODIMENTS

Figure 1:
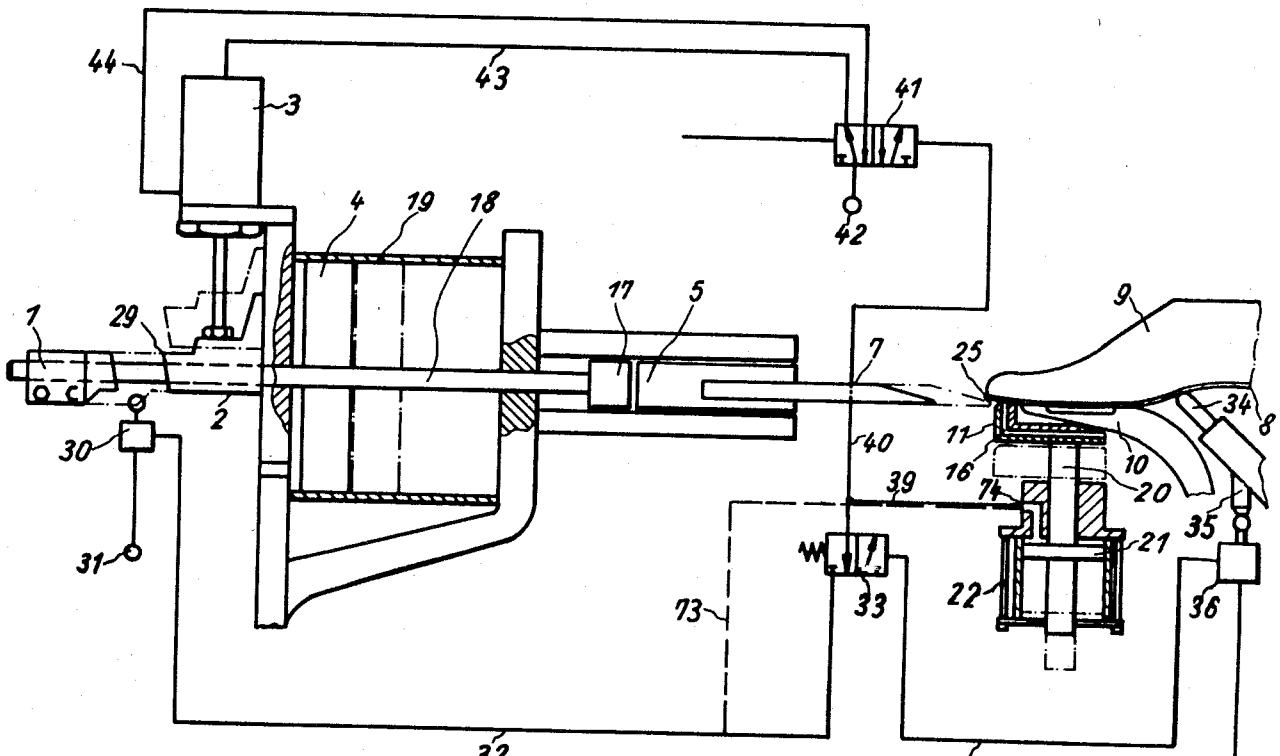
FIG. 1 is an illustration of the principle, showing the apparatus comprising a latching member.

In FIG. 1 is shown a lasted shoe 9 which is held in its position (see also FIG. 4) by means only partially shown in FIG. 1. Against the insole 8 of the shoe 9 is disposed a shoe support 10 which is so small that it remains in position even when the wiper assembly is moved together. Furthermore pressed against the insole 8 is the injector plate 11 which substantially surrounds the shoe support 10. The injector plate 11 has channels 16 which serve for the supply of adhesive. In front of the shoe is disposed the wiper assembly 7 which is journalled in the mounting 5. The wiper assembly 7 is actuated by means of the ram head 17, which applies pressure to the mounting 5. The ram head 17 is positioned at the end of the ram 18, which serves as the advancing arrangement for the wiper assembly and which is journalled in the piston 4. The piston 4 is moved to-and-fro in the cylinder 19 by means of hydraulic or pneumatic forces. The ram 18 extends through the piston 4 towards the other side and terminates in the abutment 1. When the piston 4 is advanced towards the right the abutment 1 of the ram 18 moves therewith until the abutment 1 reaches the chain-dot position in which it engages the wedge 2. The wedge 2 is supported on the actuator mechanism 3 which enables the wedge 2 to be withdrawn.

The injector plate 11 is mounted on actuating means comprising the ram 20 and the piston 21, the latter being moved hydraulically or pneumatically to-and-fro in the cylinder 22.

When this apparatus is actuated the following detailed steps take place:

In response to an appropriate initiation, e.g. actuation of the apparatus by an operator by depressing a treadle, the piston 4 is hydraulically or pneumatically actuated. The piston 4 is thus moved to the right, moving both the wiper assembly 7 therewith, through the ram head 17, and also the abutment 1, through the ram 18. This advancing movement takes place until the abutment 1 engages the wedge 2, whereupon the wiper assembly assumes the chain-dot position in which it has just traversed the lasting margin 25. The continuation of movement of the piston 4 of the wiper assembly 7 is prevented first by the engagement of the abutment 1 with the wedge 2. With the engagement of the abutment 1 with the wedge 2 the valve 30, which serves as a signalling device, is actuated, whereby the pressure medium supplied to the source 31 is switched and applies pressure in the line 32, which leads to the latching valve 33, serving as a latching member.

By means of an advance control (which is known but not of interest in this connection), furthermore, the adhesive injector nozzle 34 is guided over the insole 8 adjacent the lasting margin, and indeed starting from the injector plate 11 away therefrom, the injector nozzle 34 passing over substantially the ball region of the lasted shoe 9. During this advance of the injector nozzle 34, the latter, by means of its cam 35, engages the plunger of the valve 36, as shown in FIG. 1, so that in the position shown the valve 36 is switched through the injector nozzle 34 and thus the pressure fluid at the source 37 is switched via the line 38 to the latching valve 33. The continuation of the movement of the injector nozzle 34 is then maintained, as well as the supply of adhesive; details in this connection are not material.

By switching the presssure fluid through the valve 36 the latching valve 33 is switched, whereupon the pressure fluid at the line 32 is switched through on the one hand to the line 39, which leads to the cylinder 22, and on the other hand through the line 40, from where the fluid pressure is supplied to the auxiliary valve 41. At the cylinder 22 the supplied pressure fluid effects the downward movement of the piston 21 and thus the falling away of the injector plate 11, which finally reaches the chain-dot position. The injector plate thus no longer stands in the way of the continuation of the movement of the wiper assembly 7.

At the source 42 for the auxiliary valve 41 pressure fluid is also available, which is switched, when charged via the line 40, so that the pressure is removed from the line 43 and switched to the line 44. The actuating mechanism 3 was previously actuated via the line 43 and thus had brought the wedge 2 into the position shown in FIG. 1. With the switching of the pressure from line 43 to line 44 the actuator mechanism 3 is now actuated in reverse direction, so that it withdraws the wedge 2 into the position shown in chain-dot. As a consequence of the inclination of the abutment surfaces 29 this withdrawal of the wedge 2 can take place without difficulties. In this way, the further path of the piston 4 with the ram 18 is left free, so that the wiper assembly 7 can advance further from its intermediate position shown in chain-dot into its end position. In this movement it is not hindered by the pressure plate 11, since the latter, as already mentioned, has previously fallen away (see chain-dot position). By the actuation of the valve 36, which acts as a sensor, it is also thereby ensured that the injector nozzle 34, and in the same way also the other injector nozzle for the other side of the shoe, not shown in FIG. 1, is moved out of the region which is traversed by the wiper assembly, so that altogether the closing of the wiper assembly 7 is in no way hindered.

The auxiliary valve 41 has not only the object of switching pressure from the line 43 to the line 44 and vice versa, but also exercises the function of a control delay means independent of said lowering means for activating said advancing means, since the effect of the pressure fluid switched from the latching valve 33, which serves as a means for conjointly actuating said lowering means and said control delay means, is delayed in respect of its acting upon the actuator mechanism 3. The pressure fluid supplied via the line 39 in fact acts directly on the cylinder 22 and effects thereby the immediate falling away of the injector plate 11, in comparison with which the further movement of the wiper assembly 7, made possible by the actuator mechanism 3 in withdrawing the wedge 2 is initiated only after the valve 41 has been switched. Between the actuation of the piston 21 in the cylinder 22 and the actuation of the actuator mechanism 3, therefore, there is, as a time differential, the switching time of the auxiliary valve 41. This leads to an enhancement of the certainty against a collision of the wiper assembly 7 against the injector plate 11 or injector nozzles 34.

In FIG. 1 the line 73 shown in dotted branching from the line 32 is drawn in and connects the line 32 directly with the input port 74 of the cylinder 22. If the line 73 is utilised, the line 39 is omitted. In this type of control a direct initiation of the falling away of the injector plate 11 is achieved by the "fall away" signal supplied via the line 32 so that, upon the "fall away" signal being supplied when the abutment 1 engages the wedge 2 (actuation of the valve 30), the injector plate 11 immediately falls away. In this case, therefore, the latching valve 33 is bypassed by the "fall away" signal.

Figure 2:
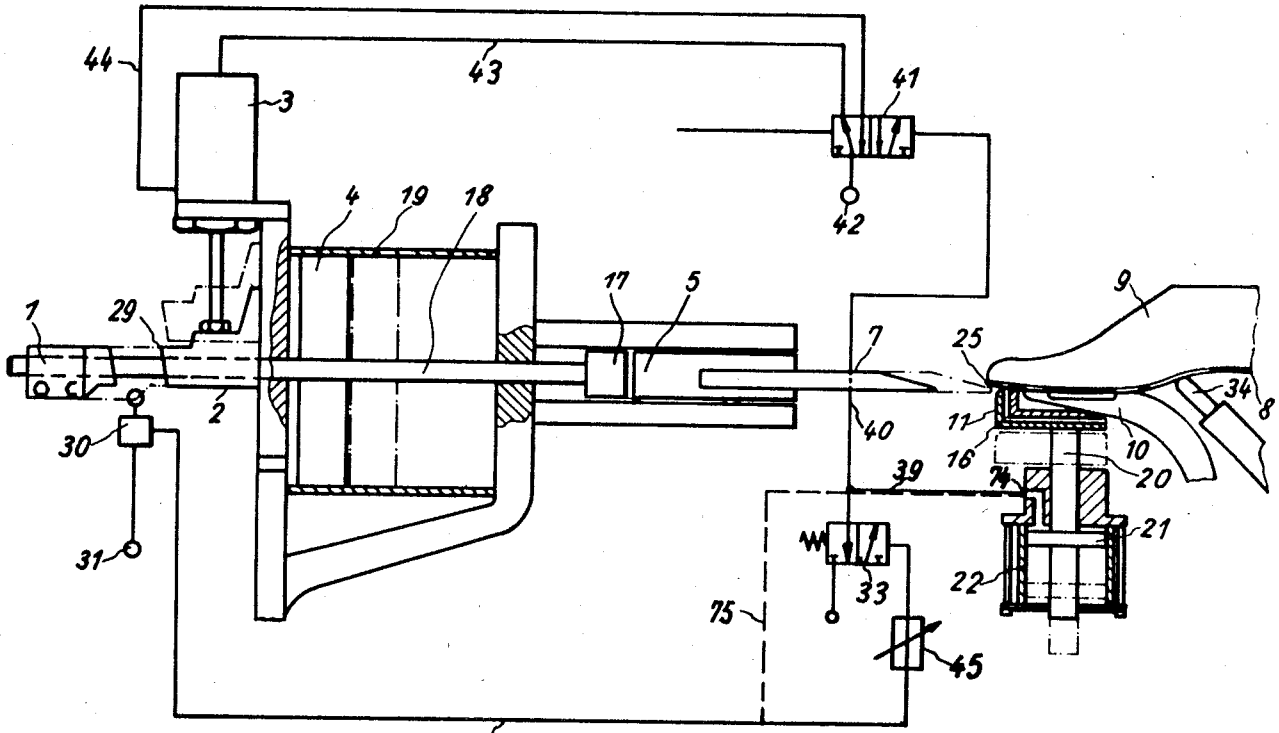
FIG. 2 shows the same apparatus with a timer member.

In the the exemplary embodiment shown in FIG. 2 it is a matter of a modification vis-a-vis the exemplary embodiment of FIG. 1. The modification consists of the latching valve 33, which serves as the conjointly actuating means, further comprises second control delay means. Said second control delay means comprises a timer member 45 which serves to actuate latching valve 33 so that the cam 35, shown in FIG. 1 and constituting the sensor, together with the valve 36 can be omitted. Apart from this difference the device of FIG. 2 operates in the same way as that of FIG. 1, so that in this regard reference can be had to the explanations to FIG. 1. In accordance with FIG. 2 the pressure fluid switched through by valve 30 is supplied via the line 32 and the timer member 45 to the latching valve 33, so that the latching valve 33, after the expiry of the time span defined by the timer member 45, is switched and thereafter initiates the steps explained with reference to FIG. 1, namely first the falling away of the injector plate 11 and, delayed by the auxiliary valve 41, the withdrawal of the wedge 2 and thereby the continuation of the movement of the wiper assembly 7. This timer member 45 is so adjusted that the switching of the latching valve 33 only takes place when the adhesive injector nozzle 34 has with certainty moved sufficiently far that it can no longer hinder the closing of the wiper assembly. In order to be able in such case to take account of the different advance times of the injector nozzles 34, it is a question with this timer member 45 of an adjustable component, as is customary in the trade.

In FIG. 2 is drawn in the line 75 (shown in dotted line) branching from the line 32, and, when it is used, replacing the line 39. The line 75 thus leads directly from the pipe 32 to the input ports 74 of the cylinder 22 so that therefore in this case the timer member 45 and the latching valve 33 is (sic) bypassed. Using this control given by the line 75, similarly as in connection with the line 73 described with reference to FIG. 1, a direct initiation of the falling away of the injector plate 11 takes place in the case of the provision of the "fall away" signal by the valve 30, so that therefore the falling away of the injector plate 11 is initiated already when the wiper assembly reaches its stop position.

Figure 3:
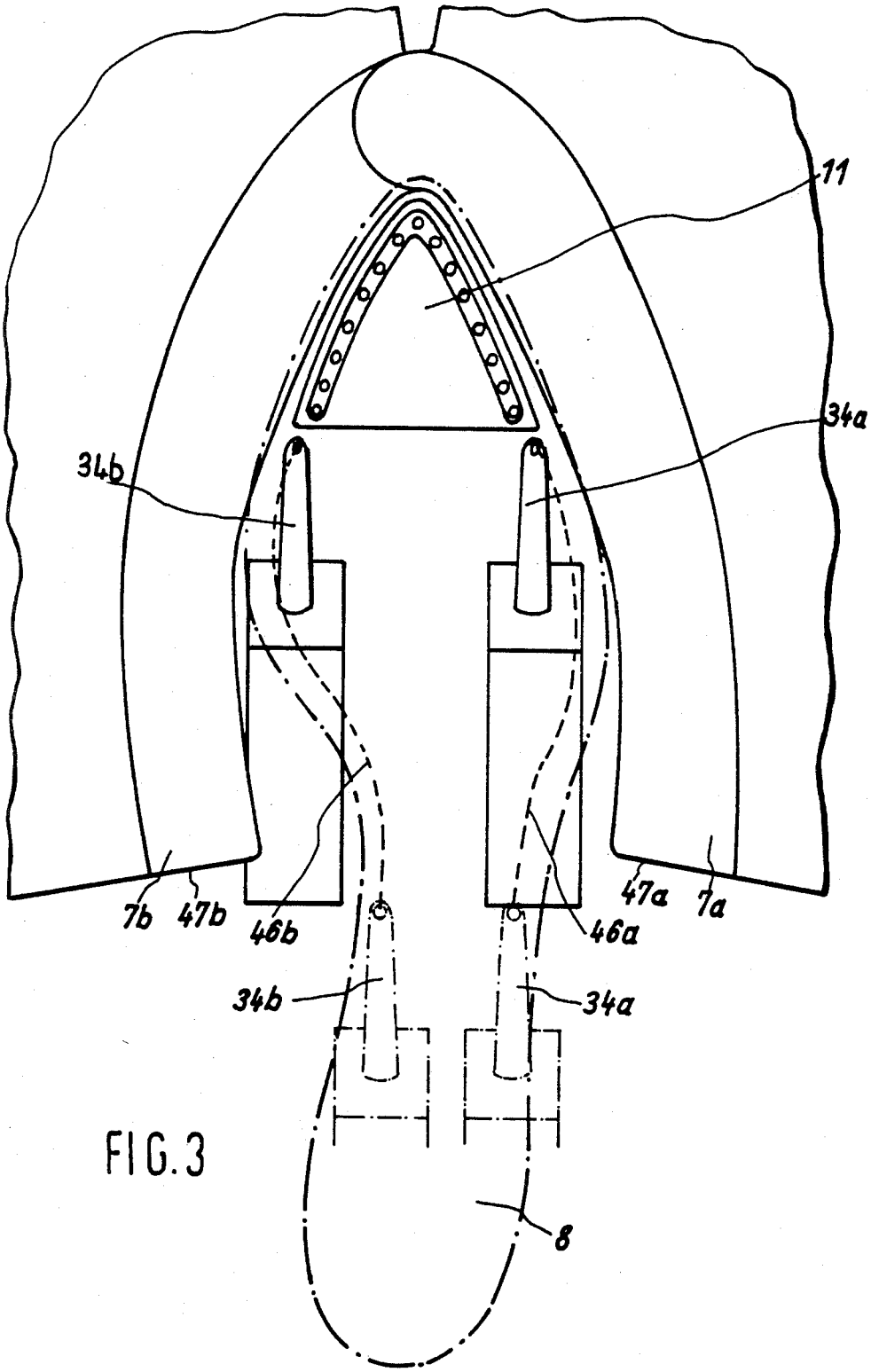
FIG. 3 is a plan view of a wiper assembly in intermediate position of the injector plate and injector nozzles.

In FIG. 3 is shown, in simplified diagrammatic form, the mutual disposition of the injector plate 11 and the injector nozzles 34*a* and 34*b*; in FIGS. 1 and 2 only one of the injector nozzles 34 is shown. As can be seen, the injector plate 11 covers a region of the shoe forepart portion which extends from the toe to about the middle thereof. Adjacent thereto the injector nozzles 34*a* and 34*b* are displaced, said nozzles running up to beyond the ball region. In this way they lay on the insole 8 the two adhesive bands 46*a* and 46*b* shown in dotted line, which bands extend in the region of the heel seat according to the particular guide mechanism for the adhesive nozzles 34*a* and 34*b*. In each case however these bands 46*a* and 46*b* extend in the region of the operating mode of the wiper assembly 7*a*, 7*b* so that, therefore, as shown in connection with FIGS. 1 and 2, it is ensured that the adhesive nozzles 34*a* and 34*b* are moved out of the region of the wiper assembly 7*a*, 7*b* when the latter is closed.

It is pointed out in this connection that the position of the injector nozzles 34*a* and 34*b* enabling the wiper assembly 7*a*, 7*b* to be closed can be achieved in different ways. Firstly it is possible to move the injector nozzles 34*a* and 34*b* away from the injector plate 11 sufficiently far in the direction of the heel seat that the adhesive nozzles 34*a* and 34*b* are displaced in this direction sufficiently from the wiper ends 47*a* and 47*b*. The adhesive nozzles 34*a* and 34*b* assume then the position shown in chain-dot line. It is however also possible to raise the adhesive nozzles 34*a* and 34*b* at the end of their advancing movement over the insole 8 away from the latter sufficiently far that the wiper assembly 7*a*, 7*b* can move past the adhesive nozzles 34*a* and 34*b*. In this case it is possible to allow the advancing movement of the adhesive nozzles 34*a* and 34*b* to run from the heel end in the direction of the toe of the shoe and, at the end of this advancing movement, to raise the adhesive nozzles 34*a* and 34*b* from the insole 8 immediately in front of the injector plate 11, in order to clear the path for the closing of the wiper assembly 7*a*, 7*b*.

Figure 4:
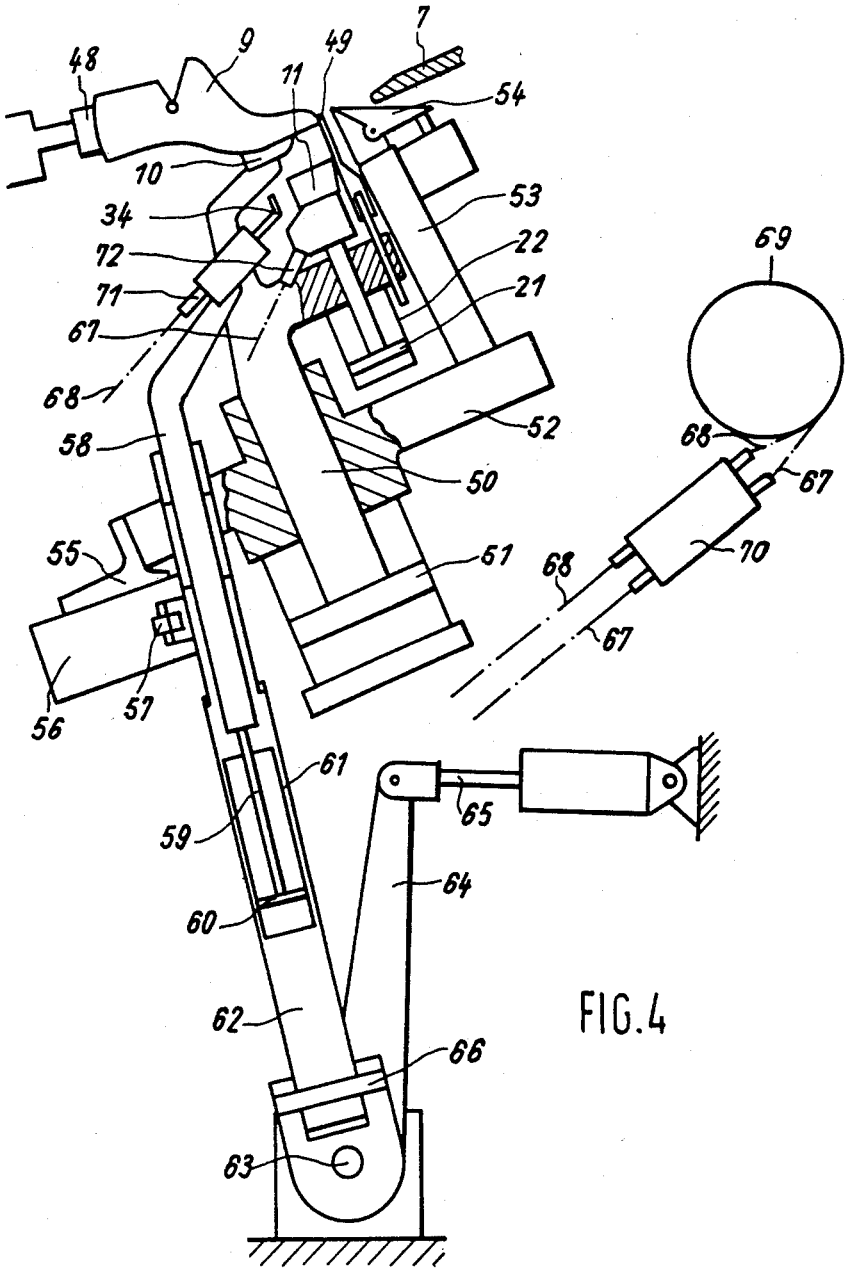
FIG. 4 shows the essential components of the apparatus for effecting movement of the injector plate and the injector nozzles.

In FIG. 4 are shown the mechanical details of the apparatus essential in this connecton, those elements of the machine however being omitted for the sake of clarity which are immaterial in this connecton and which belong in any event to the state of the art since they are conventional components of an apparatus for lasting footwear.

The apparatus shown in FIG. 4 comprises the shoe support 10 which supports the last 9, on which an upper is mounted (not shown). The last 9 is held from the heel seat thereof by the heel support 48 which applies to the last 9 from the heel seat a pressure which is accommodated by the shoe abutment 49 which holds the toe. The shoe abutment 49 is connected in known manner with the last support 50, which is carried by the piston 51. By the movement of the piston 51 the last support 50 together with the last 9 is brought into the position desired for lasting, whereupon, after lasting is completed, the last support 50 is again moved away from the last 9 together with the shoe support 10. On the last support 50 furthermore is mounted the injector plate 11 which, as described with reference to FIGS. 1 and 2, is movable to-and-from by means of the piston 21 in the cylinder 22. In FIG. 4 the injector plate 11 is shown in the "fall away" position shown in chain-dot line in FIGS. 1 and 2.

In FIG. 4 is also shown a portion of the machine frame 52 on which both the last support 50 and also further elements are secured namely the support 53 for the pincers 54 for pulling the upper over the last 9 (the further pincers are not drawn in for reasons of clarity) and the holder 55 for a stack of templates 56 which are sensed in known manner by the roll 57, whereby the necessary movement is given to the injector nozzle 54 (and the further injector nozzle (not shown)).

The injector nozzle 34 is mounted on the end of the carrier arm 58 which is connected via the piston rod 59 with the piston 60. The piston 60 is moved to-and-fro in the cylinder 61 by means of pneumatic or hydraulic means, whereby a corresponding movement of the injector nozzle 34 ensues. The carrier arm 58 together with the piston rod 59, the piston 60 and the cylinder 61, rests in the swinging arm 62 which is mounted for rotation on the axis 63. The lever 64 is connected with the swinging arm 62 and is also connected at its end with the piston rod 65 by to-and-fro movement of which the lever 64 is corresponding swung, since it is also journalled for pivoting movement on the axis 63. By the pivotal movement of the lever 64 the latter moves the swinging arm correspondingly therewith. The swinging arm 62 is, furthermore, rotatably mounted on the axis 66 in such a manner that the swinging arm 62 can be pivoted out of and into the plane of the drawing. By being able to be moved as aforesaid any desired advancing movement can be given to the nozzle 34, so that it is possible to accommodate to the shape of the bottom of the last 9 and to move away as necessary out of the closing area of the wiper assembly 7.

Also in FIG. 4 is schematically shown the supply of adhesive to the injector nozzle 34 and to the injector plate 11. The adhesive, in the form of rods 67 and 68, is unwound from the rolls 69, the feed mechanism 70 serving this purpose. The rods 67 and 68 (shown interrupted for reasons of clarity) then arrive at the inlet 71 for the injector nozzle 34 and the inlet 72 for the injector plate 11, whereupon they are heated in known manner so that flowable adhesive exits at the injector nozzle 34 and the injector plate 11. It should in this connection by pointed out that the adhesive rod 68 is present in duplicate since, as shown in FIG. 3, two adhesive nozzles 34 are provided. In the case of the adhesive rods 67 and 68, as already mentioned above it can be a question of rods of different adhesive in order to fulfil special flexibility conditions in the lasted shoe.

I claim:

1. A shoe lasting machine including a support for a shoe having a last with an upper assembled thereon and an insole secured thereto comprising wiper assembly means, means for displacing said wiper assembly means from a retracted position to an intermediate position, means for advancing said wiper assembly means from said intermediate position to an advanced position, injector plate means, means for lowering said injector plate means from an operable position to a retracted position, control delay means independent of said lowering means for activating said advancing means, and means for conjointly actuating said lowering means and said control delay means.

2. A shoe lasting machine according to claim 1, further comprising means for sensing that said wiper assembly means has been advanced to said intermediate position, injector nozzle means, and means for indicating that said injector nozzle means has been displaced to a selected position permitting displacement of said wiper assembly means from said intermediate position to said advanced position, and said control delay means operable after said sensing means senses that said indicating means indicates that said injector nozzle means has been displaced to said selected position.

3. A shoe lasting machine according to claim 2, wherein said indicating means comprises a switch.

4. A shoe lasting machine according to claim 2, wherein said indicating means comprises a first timer means.

5. A shoe lasting machine according to claim 1, wherein said conjointly actuating means further comprises second control delay means.

6. A shoe lasting machine according to claim 5, wherein said second control delay means comprises a timer.

7. A shoe lasting machine according to claim 5, further comprising means for sensing that said wiper assembly means has been advanced to said intermediate position, injector nozzle means, and means for indicating that said injector nozzle means has been displaced to a selected position permitting displacement of said wiper assembly means from said intermediate position to said advanced position, said second control delay means including latch means operable after said sensing means senses that said wiper assembly means has been advanced to said intermediate position and after said indicating means indicates that said injector nozzle means has been displaced to said selected position.

* * * * *